US008122932B2

(12) United States Patent
Cannaverde

(10) Patent No.: US 8,122,932 B2
(45) Date of Patent: Feb. 28, 2012

(54) MULTI-SECTION WINDOW DRESSING WITH COUPLING CLUTCH

(75) Inventor: Joseph Cannaverde, Stamford, CT (US)

(73) Assignee: RollEase, Inc., Stamford, CT (US)

( * ) Notice: Subject to any disclaimer, the term of this patent is extended or adjusted under 35 U.S.C. 154(b) by 368 days.

(21) Appl. No.: 12/356,596

(22) Filed: Jan. 21, 2009

(65) Prior Publication Data

US 2010/0181031 A1 Jul. 22, 2010

(51) Int. Cl.
*A47H 1/00* (2006.01)

(52) U.S. Cl. ..... 160/120; 160/323.1; 160/324; 160/325; 160/121.1; 248/256; 248/257; 248/258; 248/259; 248/265; 248/266; 248/267; 248/269; 475/331

(58) Field of Classification Search ..... 160/120, 160/121.1, 323.1, 324, 325; 242/388.6–388.8; 248/256–260, 265–270; 475/331, 263, 264, 475/265

See application file for complete search history.

(56) References Cited

U.S. PATENT DOCUMENTS

| | | | | | |
|---|---|---|---|---|---|
| 1,351,403 | A | * | 8/1920 | Sager | 296/143 |
| 1,437,851 | A | * | 12/1922 | Lange | 248/267 |
| 1,499,340 | A | * | 7/1924 | Bundy, Jr | 248/269 |
| 1,535,591 | A | * | 4/1925 | Ferrara | 160/324 |
| 1,606,986 | A | * | 11/1926 | Clark | 160/328 |
| 2,013,500 | A | * | 9/1935 | O'Connor | 248/269 |
| 2,094,540 | A | * | 9/1937 | Kirchen | 248/270 |
| 2,198,088 | A | * | 4/1940 | Peckham | 248/265 |
| 2,341,217 | A | * | 2/1944 | Holtzclaw | 248/265 |
| 2,463,110 | A | * | 3/1949 | Johnson | 248/496 |
| 2,480,438 | A | * | 8/1949 | Bergman et al. | 248/257 |
| 2,651,489 | A | * | 9/1953 | Bell | 248/265 |
| 3,730,469 | A | * | 5/1973 | Shields | 248/265 |
| 4,120,474 | A | * | 10/1978 | Hurley | 248/263 |
| 4,179,091 | A | * | 12/1979 | Bidney | 248/265 |
| 4,751,953 | A | * | 6/1988 | Appel et al. | 160/313 |
| 5,009,259 | A | * | 4/1991 | Miloslaus | 160/323.1 |
| 6,135,403 | A | * | 10/2000 | Goldstein | 248/253 |
| 6,196,508 | B1 | * | 3/2001 | Nijs | 248/267 |
| 7,051,782 | B2 | | 5/2006 | Nichols, Jr. | |
| 7,451,956 | B2 | * | 11/2008 | Bohlen | 248/265 |
| 2002/0189771 | A1 | * | 12/2002 | Colson et al. | 160/323.1 |
| 2004/0226663 | A1 | | 11/2004 | Smith et al. | |
| 2005/0183835 | A1 | * | 8/2005 | Nien | 160/321 |
| 2006/0272782 | A1 | * | 12/2006 | Nichols et al. | 160/120 |
| 2007/0253768 | A1 | * | 11/2007 | Li et al. | 403/305 |
| 2008/0067278 | A1 | * | 3/2008 | Fortunato et al. | 242/407 |
| 2008/0142171 | A1 | * | 6/2008 | Koop et al. | 160/243 |
| 2011/0061817 | A1 | * | 3/2011 | Smith | 160/121.1 |

FOREIGN PATENT DOCUMENTS

AU 200189239 A1 5/2002

(Continued)

*Primary Examiner* — Katherine Mitchell
*Assistant Examiner* — Marcus Menezes
(74) *Attorney, Agent, or Firm* — Gottlieb, Rackman & Reisman, P.C.

(57) ABSTRACT

The present application pertains to a system for adjusting the height of a covering, such as window or a wall covering formed of two or more covering segments that are axially aligned. The system includes a link that selectively transmits rotation between two adjacent coverage thereby allowing the two coverings to be controlled, e.g., raised or lowered, simultaneously. The link includes a clutch that allows one of the segments to be rotated with respect to the other so that the bottom end of one of the coverings can be adjusted and aligned horizontally independently of the other. Optionally, the clutch includes an internal member that provides a mechanical advantage while the one covering is adjusted.

23 Claims, 5 Drawing Sheets

FOREIGN PATENT DOCUMENTS

| | | |
|---|---|---|
| DE | 4227425 | 3/1994 |
| DE | 19546203 | 3/1997 |
| EP | 0863290 | 9/1998 |
| WO | WO 2006/042377 A1 | 4/2006 |

* cited by examiner

MULTI-SECTION WINDOW DRESSING WITH COUPLING CLUTCH

RELATED APPLICATIONS

The subject matter of this application is related to the subject matter of commonly assigned application Ser. No. 11/567,468 filed Dec. 6, 2006, now abandoned, and incorporated herein by reference in its entirety.

BACKGROUND OF THE INVENTION

1. Field of the Invention

The invention relates to the field of window dressing. More specifically, the invention provides a link system for coupling a plurality window coverings end-to-end so that they can be controlled (e.g., raised and lowered) simultaneously, the link system being adapted to allow one of the coverings to be adjusted vertically with respect to another by an angular displacement thereof.

2. Description of the Prior Art

Window treatments are conventionally installed on windows and doors to provide privacy, to form a thermal barrier against heat or cold, as well as for esthetic reasons. In some instances, for example, in some large installations most frequently required in industrial or commercial environments) since the width of a typical window covering, such as a window shade, is somewhat limited, several such coverings are arranged adjacent to each other. The conventional practice for these types of installations was to provide individual pull cords for each individual window covering. This structure is acceptable if it is desired to control the height of each window covering individually. However, it is time consuming and difficult to set all the window coverings to the same height, Moreover, a major problem with coupled window covering such as shades is telescoping. Telescoping occurs when the window covering fabric rolls up in an uneven manner. Instead of lining up in the same horizontal position, the edges of the window covering shift either to the left or to the right. This shift may be insignificant at first, but over time, and especially for long window coverings, the shift increases significantly and eventually the covering shifts far enough to one side or the other so that it interferers with either with its own control mechanism or the control mechanism or even the actual panel of an adjacent treatment. Telescoping is especially prevalent when the window coverings are not hung horizontally.

Window coverings may not be horizontal for several reasons. While some ceilings are constructed with a nominally uniform height, many times, there are minute differences in height from one side of a room to another. This is especially true with windows or ceilings in older buildings. Over time the earth shifts, buildings settle and materials warp. These factors cause a lack of uniformity in the height of the ceiling. When standard window covering mounts are attached to the non-uniform ceiling, the problem of telescoping, as described above occurs when standard mounting hardware is used. Telescoping may also occur if two adjacent window covering segments are not properly aligned with each other.

A further problem with multiple window coverings is that even if they are coupled together, in some instances, for example, because of a slight angular offset, it is difficult to insure that the bottom of each window covering (or, more appropriately, the bottom of the window covering panel) is perfectly aligned with the adjacent window coverings (if any). However, window coverings are almost always placed at locations with very high visibility and even a slight vertical offset between adjacent window coverings is highly visible and esthetically objectionable.

Some typical coupling systems for window treatments are found in the following patents. WO 2006/042377; U.S. Pat. No. 7,051,782, EP 0863290; DE 19546203; DE 4227425; AU 200189239. However none of these references solve the problems addressed herein.

SUMMARY OF THE INVENTION

As described above, telescoping occurs when the covering is rolled up and either of the edges of the covering extends beyond the lateral limits of the shade. Telescoping is most commonly caused when the window covering is installed and is not completely horizontal, or when the axes of two adjacent covering segments are not completely aligned with each other. This improper installation is often caused when the window covering is installed upon a ceiling, which is not even or completely horizontal. The present invention aims to solve this problem by providing a link between adjacent coverings. Importantly, the link includes a clutch for adjusting the relative positions of the bottoms of the coverings as well to eliminate unsightly offsets therebetween.

Generally speaking, the link includes a bracket that mounts to the ceiling (or other stationary surface) and extends downward. A bearing or other support means is attached to the bracket. The bearing is held in place by a height adjusting member. In this manner, the bearing is vertically adjustable within the bracket and its position is determined by the height adjusting member.

The height adjusting member preferably includes a clip and a screw that passes through the clip and contacts the bearing. The clip and the bearing are captured by the bracket. Moreover, clip and screw are sized and shaped so that when the screw is engaged by the clip, the clip cannot be removed from the bracket without breaking it. In order to remove the clip from the bracket, the screw must be removed. Once the bracket is in place and the bearing height is set, the covering segments are aligned properly thereby eliminating telescoping.

Importantly, the link further includes a clutch that has a thumbwheel arranged to rotate one window covering with respect to the other until the bottoms of the wall coverings are aligned perfectly. The clutch may but does not necessarily provide a mechanical advantage during this operation. However, preferably, the clutch is constructed to allow infinite angular positioning between adjacent wall coverings.

The clutch also automatically couples the adjacent window coverings so that several window coverings can be moved up or down automatically. Preferably, the clutch includes one or more coil springs that selectively engage a cylindrical surface to thereby couple a mandrel of the window covering to a shaft. This arrangement allows the clutch to operate in a first mode in which one window treatment is angularly displaced with respect to the other and a second mode in which the two window treatments are interlocked and can be raised and lowered simultaneously.

BRIEF DESCRIPTION OF THE FIGURES

To further satisfy the recited objectives, a detailed description of typical embodiments of the invention is provided with reference to appended drawings that are not intended to limit the scope of the invention, in which.

DESCRIPTION OF THE INVENTION

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

Figure 1:
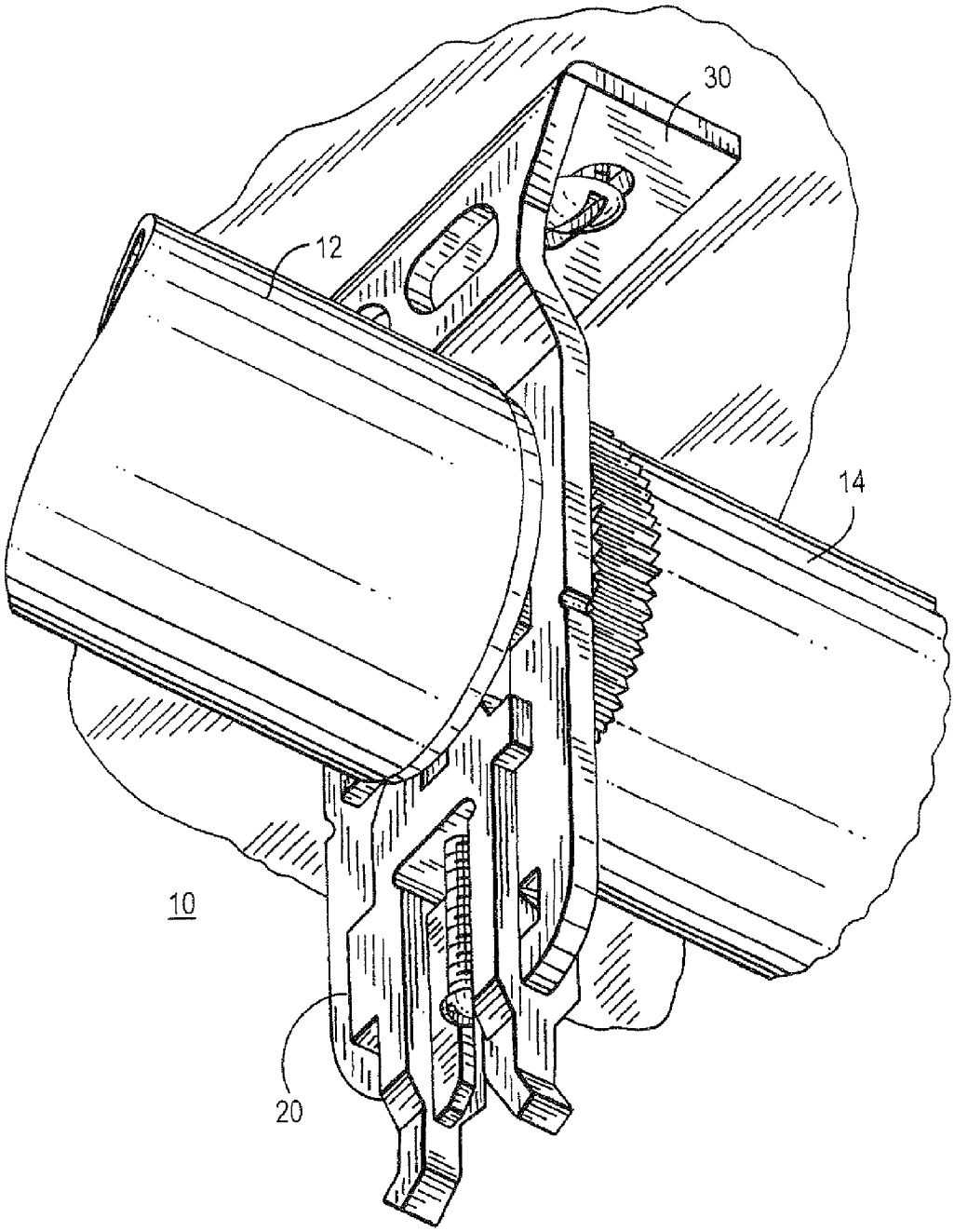
FIG. 1 is a partial perspective view of two window shades connected by a link constructed in accordance with this invention.

The present invention provides a means for preventing the problem of telescoping in several shades mounted coaxially. More specifically, as shown in FIG. 1, the present invention pertains to a system 10 including two shades 12, 14. The two shades are coupled by a link 20. For the sake of clarity, only the cylindrical barrels of the shades 12, 14 are shown, it being understood that in a typical system, the shades also include respective sheets that are attached and wound on the barrels. The two shades are aligned coaxially by the link 20 and coupled so when rotation is applied to one of the shades by control means not shown, the link 20 transmits this rotation to the other shade, thereby causing the two shades to lower or raise, depending on the direction of rotation of the mandrels. If the common axis of the two shades is not fairly horizontal, as the shades 12, 14 are raised and lowered, their sheets can telescope or migrate unto the barrel of an adjacent shade. Although in the following description a system with two shades is discussed, the invention can be extended to systems with more then two shades by employing an identical link between each shade.

In FIG. 1 link 20 is shown as being attached to ceiling or other horizontal surface. Of course the link 20 can be attached to a vertical wall, or other suitable surfaces.

Figure 2:
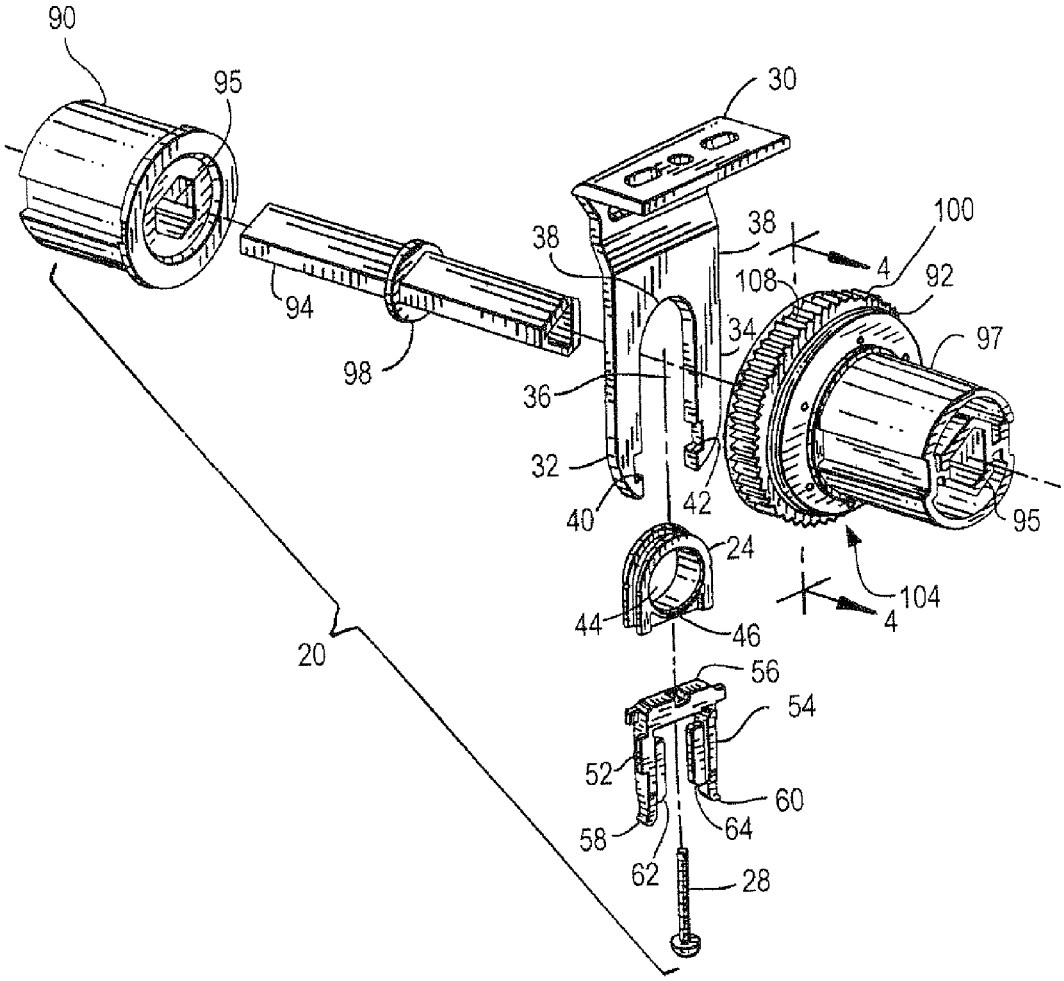
FIG. 2 is an exploded view of the link and associated elements of the shades.

FIG. 2 shows the major parts of the link 20. As can be seen in this Figure, the link 20 includes a bracket 22, a bearing 24 and a clip 26 supported by a screw 28. The bracket 22 is generally L-shaped and it attaches to the ceiling via the holes 30. The bracket 22 further includes two prongs 32, 34 extending downwardly to form an elongated opening 36. A top portion 38 of the opening 36 is semicircular to receive bearing 24. Near their bottom end, the prongs are formed with two horizontal rectangular cut-outs 40, 42.

The bearing is generally D-shaped with a round hole 44 and a circumferential groove 46. The groove 46 along the top surface and along the two side surfaces of the bearing 24. The width of the groove 46 is equal to or slightly smaller then the thickness of the prongs 32, 34 and the overall width of the bearing 24 is larger then the width of the opening 24 to allow the bearing 24 to slide vertically into the opening 36 until the bearing 24 nestles against the portion 38.

Figure 2A:
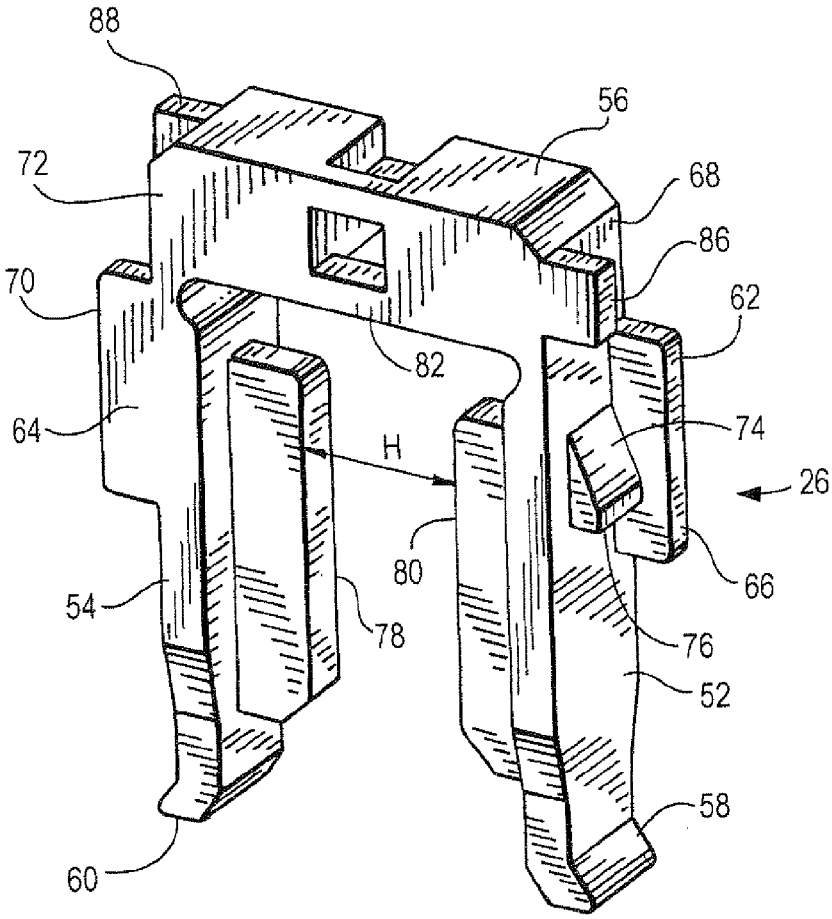
FIG. 2A shows an enlarged view of a clip that is a part of the clutch of FIG. 2.

As shown in FIG. 2A, the clip 26 is formed in the shape of an up-side-down "U" with two arms 52, 54 joined by a horizontal bar 56 and terminating with outwardly extending protrusions 58, 60. Each arm 52, 54 is formed with two lips 62, 64 that are thinner then the rest of the clip 26. The lip 62 is formed so that its rear external surface (not shown) is flush with the back surface (not shown) of clip 26 while the lip 64 is formed so that its front surface is flush with the front surface of clip 26. Adjacent to one or both lips 62, 64 there is provided a ramp 74 with a horizontal shoulder 76. The arms 52, 54 are also formed with two ribs 78, 80 extending inwardly as shown. Bar 56 is formed with a threaded hole 82 extending vertically and sized to accept screw 28. The bar 56 also has two external lips 86, 88. Lips 62, 64, 86, 88 cooperate to form vertical channels along the sides the clip 26 sized and shape to receive the two prongs 32, 34. The lips 86, 88 are sized to match the size and spacing of cuts 40, 42.

The screw 28 has a head 84 that has a width approximately equal to the horizontal distance H between the ribs 78, 80.

The clip 26 is sized and shape so that when is inserted into the bracket 22 or mated with it either from the bottom or by partially superimposing the clip 26 over the bracket 22 so that the lips 86, 88 pass through the cuts 40, 42 and then pushing the clip upward, causing the prongs 32, 34 to pass into the channels mentioned above. The two arms 52, 54 are flexible so that as the ramp(s) 74 pass between the ends of the prongs 32, 34 the arms flex slightly toward each other allowing the clip to progress further until the ramp(s) 74 reach the cuts 40, 42. At this point, the arms 52, 54 back and the clip is trapped within the bracket 22 with the shoulder 76 resting on the bottom or horizontal surface of the cuts 40, 42. The clip 26 can be removed by flexing the arms 52, 54 together thereby allowing the clip to be retrieved from between the prongs 32, 34.

The bracket is used as follows. The bearing 24 is first inserted between the two prongs 32, 34 with the prongs 30, 32 being disposed in the groove 46. Next, the clip 22 is inserted therein so that the bearing 24 is held in the bracket 22.

The shades 12, 14 are typically supported by two brackets. The brackets may have different shapes. As shown in FIG. 1, bracket 22 is used to support the shades on a ceiling or other suitable surface. As shown in FIG. 2, the assembly 10 further includes a first bushing 90 telescopically inserted into the mandrel of shade 12, a bushing 92 telescopically inserted into the mandrel of shade 14 and a shaft 94. The bushings are hollow and have an internal hole 95 shaped so that they are complementary to the cross-sectional shape of the shaft 94. Preferably, the shaft 94 has a cross-sectional shape that is other then circular so that rotation of one of the bushings, e.g. bushing 90 is easily transmitted by the shaft 94 to the other bushing 92. In FIG. 2 the shaft is triangular. Of course, many other shapes or means well know in the art may be used to insure that rotation is readily transmitted between the bushings. The bushings are inserted into the mandrels of shades 12, 14 and are maintained therein by frictional engagement or any other well known means.

The shaft 94 may also include a flange 98 that acts as a stop for the two mandrels.

Bushing 92 includes a barrel 97 which is the part of the bushing that is inserted into the shade 14, as discussed above. The bushing 92 further includes a ring 100 having on its outer surface a plurality of axial grooves 102 to define a thumbwheel. A clutch 104 is provided within the bushing 92 between the member 100 and the barrel 97, preferably at a mechanical advantage.

One purpose of the clutch 104 is to allow the member 100 rotate the mandrel 97 with respect to shaft 92. More particularly, the clutch has two modes of operation. Under a normal mode, the clutch couples the barrel 97 directly to the shaft 94 so that when the shaft is rotated by a user, the shaft rotates bushing 90 and the barrel 97 thereby raising or lowering the shades 12, 14 simultaneously. However, sometimes it may be desirable to rotate only barrel 97 without rotating the bushing 90. For example, during installation, the bottom of one of the shades may be set at a slightly different height then the other, and so, one of them may need to be adjusted. For this case, a user can rotate ring 100, for example by grasping it with the hand and turning it. The grooves 102 form a non-slip surface thereby facilitating this action. Moving the ring by a an angle in either direction, causes the clutch 104 to decouple the barrel 97 from the shaft. Further rotation of the ring 100 is transferred by the clutch to the barrel 08 thereby causing it to rotate as well. Therefore rotating ring 100 in one direction or another causes the shade 14 to move up or down without movement by the shade 12. The clutch 104 described below in more detail and it causes the barrel 97 to rotate in the same direction as the ring 100. Other types of clutches may work differently, so that the ring 100 and the barrel 97 may be rotating in opposite directions. In any event, the vertical position of the bottom of the shade 14 can be easily adjusted using the ring 100. One skilled in the art will appreciate that this adjustment need not be made in increments but that the clutch can be used to provide substantially infinitely small angular adjustment. In some instances, the shades 12, 14 may be fairly heavy. Therefore, in the preferred embodiment, the clutch provides a mechanical advantage to make this process easier. However, it should be understood that the clutch can be constructed and arranged, especially for small and/or light window dressings so that it provides no mechanical advantage. In this embodiment, the ring 100 and barrel 97 are mechanically interlocked.

Figure 3:
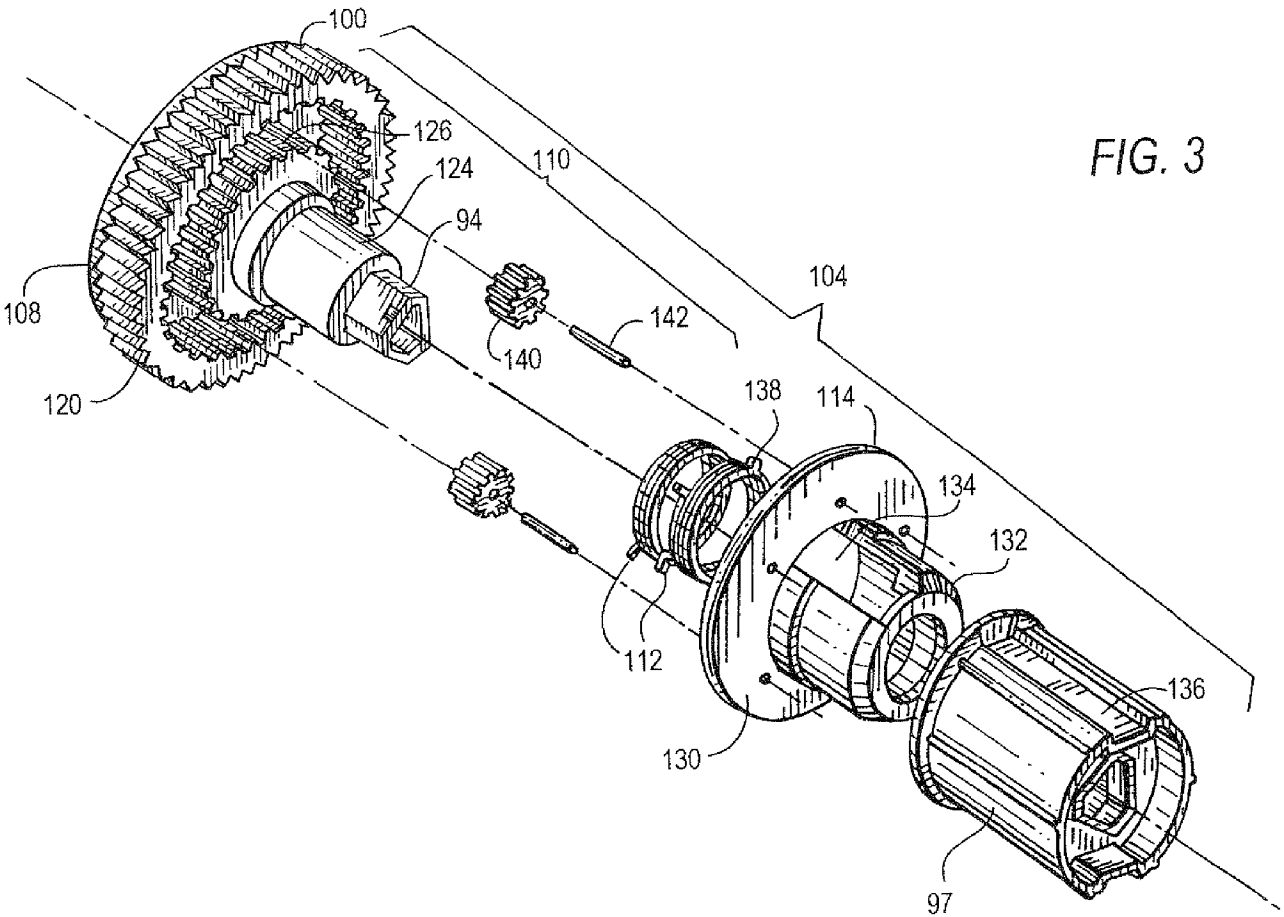
FIG. 3 is a perspective view of bushing incorporating a clutch in accordance with this invention.
Figure 5:
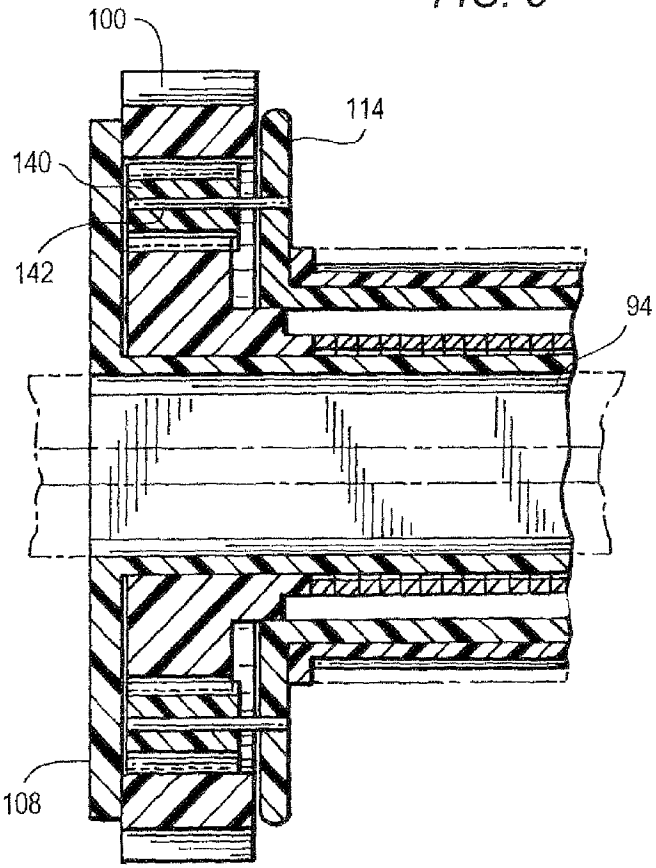
FIG. 5 is a cross-sectional view of the bushing of FIGS. 3 and 4.
Figure 4:
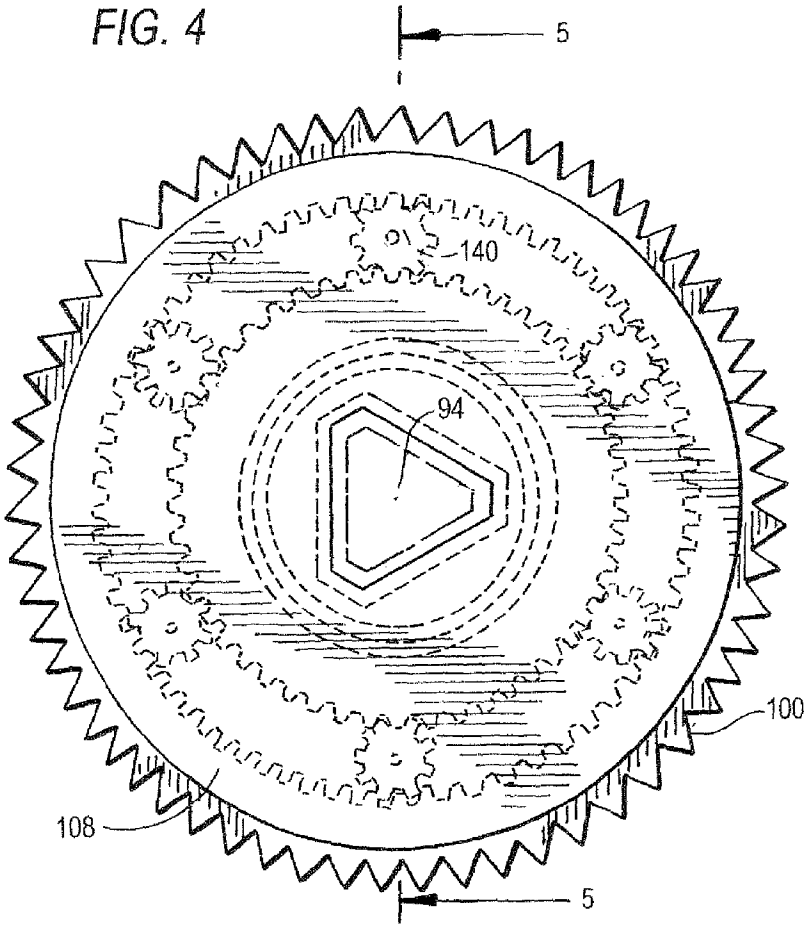
FIG. 4 is an end view of the bushing of FIG. 3.

Referring now to FIGS. 3, 4 and 5, the bushing 92 is formed of a stationary piece 108, the ring 100, the clutch 104, and an intermediate member 114. It should be understood that portions of the clutch are mounted and secured to both the stationary piece 108 and the intermediate member 114. The following is a general description of the clutch 104. A more complete description is found in commonly assigned U.S. Pat. No. 6,685,592 incorporated herein by reference.

The ring 100 is generally toroidal in shape and it includes an internal gear 120 facing inwards. The stationary piece 108 includes a backwall 122 mounted and secured to a central drum 124. The drum 124 is formed with the triangular hole 95 as discussed above, and is mounted on the shaft 94 as shown. The piece 108 further includes a sun gear 126 having teeth facing radially outward.

Intermediate member 114 has a disk-shaped wall 130 and a drum 132. The drum 132 has one or more axial slots 134. The drum 97 is formed with axial ribs 136 extending inwardly. When drum 97 is installed on top of drum 124, the ribs 136 fit into slots 134.

Springs 112 preferably have a flat cross-section and terminate in tangs 138. These springs are mounted coaxially around barrel 124 with their tangs 138 disposed in slots 134 and are separated by ribs 136. The drum 132 has an inner diameter that is larger then the outer diameter of drum 124 and the two drums 124, 132 form a toroidal space for the springs that is large enough to allow to house the springs in two configurations: a tightened configuration and a relaxed configuration. In the tightened configuration the springs frictionally engage the outer surface of drum 124. In this configuration the drum 124, the intermediate member 114, and the barrel 97 are all interlocked and any movement by shaft 94 causes the drum 97 to rotate as well.

In the second or loose configuration of the springs, the springs touch the surface of drum 124 only loosely (if at all), and therefore intermediate member 114 and drum 97 are not coupled to drum 124 and shaft 94.

As previously mentioned, preferably, the clutch provides a mechanical advantage between the ring 100 and the drum 97. This mechanical advantage is provided by the planetary mechanism 110. Gear 110 includes the stationary sun gear 126, the inner gear 120 and a plurality of planetary gears 140. Planetary gears 140 are rotating on shafts 142 mounted in a circle on disk-shaped wall 130 and are intermeshed with gears 136 and 120, as shown in FIG. 4. Therefore a rotation of ring 100 causes the gears 140 to rotate around sun gear 126 and also to rotate the intermediate member 114 and drum 97. The mechanical advantage of the planetary gear is determined by the ratio of the radius of its different elements. As discussed above, optionally, if no mechanical advantage is desired, the planetary gear may be eliminated.

The shades 12, 14 are installed in the conventional manner, with the shaft 94 being inserted into the bushings 90, 92 and also being supported by the link 20. More particularly, the ends of the shaft are disposed in the bushings 90, 92 while its mid section passes through hole 44 of bearing 24 and is supported by the link 20. At this stage, the shaft 94, the bearing 22 and the clip 24 are movable vertically between the prongs 32, 34.

Next, the screw 28 is inserted between the arms 32, 34 and is rotated clockwise so that its tip is engaged by hole 82. The screw 28 is then rotated by a screwdriver or other known means causing it to advance vertically upward through the clip 26 thereby coming into contact with the bottom wall 45 of bearing 24. Advancing the screw 28 further causes the bearing 24 to rise. In this manner the position of the bearing 24 can be adjusted until the shades 12, 14 are properly aligned with each other and are disposed in a substantial horizontal position.

Because the width of the screw head 84 matches the distance between arms 40, 42, the head 84 prevents the arms 40, 42 from flexing thereby effectively entrapping the clip 24 within the prongs 30, 32. The assembled link 20 with shaft 94 and bushing 90 are shown in FIG. 1.

In summary, a link is provided for coupling two window coverings or dressings such that one window covering can be angularly adjusted with respect to the other (to set the height of the bottom of the window covering on the window). The clutch is arranged so that this relative angle is infinitely adjustable. The clutch also selectively interlocks the two window coverings so that they can be operated simultaneously by a user.

Obviously numerous modifications can be made to the invention without departing from its scope as defined in the appended claims. Moreover, it should be understood that while in the preferred embodiment, the invention was described in conjunction with a shade, it is equally applicable with other different types of apparatus for covering wall, openings, and so on.

I claim:

1. A link for coupling a first window and a second window covering, said window coverings being disposed coaxially and having respective mandrels, with the mandrel of one window covering being disposed adjacent to the mandrel of the second window covering, comprising:

a first bushing sized and shaped to be introduced telescopically into the mandrel of the first window covering, said first bushing having a shaft opening;

a second bushing sized and shaped to be introduced telescopically into the mandrel of the second window covering, said second bushing having a shaft opening;

a shaft extending between and through said shaft openings, said shaft transmitting rotational forces between said mandrels;

a clutch coupled to one of said bushings and having a first mode of operation in which said mandrels are rotationally interlocked through said shaft and a second mode of operation in which one mandrel is selectively rotated with respect to the other; and a bracket disposed in between and being disconnectable from said bushings, said bracket having a hole, said shaft passing through said hole and being supported by said bracket, wherein said first bushing includes a first drum having an outer surface supporting said first window covering; a second drum disposed radially inwardly of said first drum and engaging said shaft and a mechanism disposed between said first and said second drums to selectively engage and disengage said drums from each other.

2. The link of claim 1 further comprising a bearing vertically movable within said bracket and receiving said shaft; and a height adjusting member secured to said bracket and arranged to adjust the height of said bearing within said bracket to set the positions of said bushings.

3. The link of claim 1 wherein said shaft and the shaft openings are non-circular.

4. The link of claim 1 wherein said clutch is constructed to provide a mechanical advantage for rotating the respective mandrel.

5. The link of claim 4 wherein said clutch includes a planetary coupling providing said mechanical advantage.

6. A covering system comprising:

a plurality of covering segments, each segment having ends; and the link of claim 1 arranged and constructed to selectively decouple one of said covering segments from said shaft, wherein once decoupled said one covering segment is infinitely rotatable independently of said other covering segment.

7. The system of claim 6 further comprising the bracket arranged to adjust the distance between said link and a stationary support.

8. The covering system of claim 6 wherein said link includes the first or second bushing attached to said one covering segment, said bushing including a ring position to be manipulated by a user after the covering system has been installed, a drum attached to said one covering segment and the clutch having a first position and a second position, wherein in said first position said drum is rotationally coupled to said shaft, and wherein in said second position, the drum is decoupled from said shaft to allow said one covering segment to rotate with respect to said shaft.

9. The covering system of claim 8 wherein said coupling provides a mechanical advantage between said ring and said drum.

10. The covering system of claim 9 wherein said clutch includes a planetary mechanism providing said mechanical advantage.

11. The covering system of claim 8 wherein said clutch includes a coil spring and an intermediate member selectively tightening and loosening said coil spring to control the coupling and decoupling to said shaft.

12. The covering system of claim 8 wherein said ring forms a thumbwheel.

13. The link of claim 1 wherein said mechanism includes a spring having first and second spring ends engaging said first and second drums, respectively.

14. The link of claim 1 wherein said shaft is not shifted axially while said window covering is locked and disengaged from the shaft.

15. A link for coupling two coverings disposed end to end, said link comprising:

a shaft extending between the adjacent ends of the two coverings and being adapted to selectively transmit rotation therebetween;

a clutch disposed between said shaft and one of the coverings to selectively lock said one covering to said shaft to allow the shaft to rotate both coverings simultaneously, and to selectively unlock said one covering from said shaft to allow said one covering to rotate independently of said shaft; and a ring mounted on the end of one of the two coverings and arranged to selectively couple and decouple said one of the two coverings from said shaft through said clutch, said ring being accessible for manual manipulation after said coverings are mounted on a stationary support to effectuate a manual height adjustment of said one covering without moving the other covering.

16. The link of claim 15 further comprising:

a bracket engaging and supporting said shaft at a portion thereof disposed between the coverings, said bracket being axially spaced from and separate from said coverings.

17. The link of claim 16 wherein said bracket includes an adjusting member for selectively positioning said bracket to adjust the distance between said window coverings and a stationary support.

18. The link of claim 15 further comprising a bushing having a drum engaging said one covering, said ring being disposed coaxially with said drum and said shaft, said bushing and said clutch being constructed and arranged to selectively unlock said drum and said shaft in response to a rotation of said ring.

19. The link of claim 18 wherein said clutch provides a mechanical advantage between said ring and said drum.

20. The link of claim 19 wherein said clutch includes a planetary coupling providing said mechanical advantage.

21. The link of claim 15 wherein said clutch includes a coil spring that is selectively coiled and uncoiled to engage and disengage said shaft.

22. The link of claim 15 wherein said clutch includes a first drum having an outer surface supporting said first covering; a second drum disposed radially inwardly of said first drum and engaging said shaft and a mechanism disposed between said first and said second drums to selectively engage and disengage said drums from each other.

23. The link of claim 22 wherein said mechanism includes a spring having first and second spring ends engaging said first and second drums, respectively.

* * * * *